US006611984B1

(12) United States Patent
Halm

(10) Patent No.: US 6,611,984 B1
(45) Date of Patent: Sep. 2, 2003

(54) TOOTHBRUSH

(75) Inventor: Hans Halm, Camp de Mar (ES)

(73) Assignee: SmithKline Beecham GmbH & Co. KG, Buehl (DE)

( * ) Notice: Subject to any disclaimer, the term of this patent is extended or adjusted under 35 U.S.C. 154(b) by 0 days.

(21) Appl. No.: 09/508,747

(22) PCT Filed: Sep. 22, 1998

(86) PCT No.: PCT/EP98/06041

§ 371 (c)(1),
(2), (4) Date: Mar. 15, 2000

(87) PCT Pub. No.: WO99/16332

PCT Pub. Date: Apr. 8, 1999

(30) Foreign Application Priority Data

Sep. 26, 1997 (GB) ..... 9720504
Feb. 4, 1998 (GB) ..... 9802247

(51) Int. Cl.[7] ..... A46B 5/00
(52) U.S. Cl. ..... 15/167.1; 15/144.1; 15/172
(58) Field of Search ..... 15/144.1, 167.1, 15/172

(56) References Cited

U.S. PATENT DOCUMENTS 1,222,971 A * 4/1917 Moe ..... 15/144.1 X
1,894,509 A * 1/1933 Booth ..... 15/167.1 X
1,968,303 A * 7/1934 McMath ..... 15/167.1
2,122,619 A * 7/1938 McMath ..... 15/167.1
2,130,661 A * 9/1938 Zaebst ..... 15/167.1
2,657,412 A * 11/1953 Carlson ..... 15/167.1 X
3,493,991 A * 2/1970 De Bianchi ..... 15/167.1 X
4,038,716 A * 8/1977 Polsfuss ..... 15/144.1 X
4,731,896 A * 3/1988 De La Tour ..... 15/167.1 X
4,924,547 A * 5/1990 Wachtel et al. ..... 15/144.1 X
5,054,154 A 10/1991 Schiffer et al. ..... 15/167.1
5,282,291 A 2/1994 Spieler et al. ..... 15/167.1
5,707,166 A 1/1998 Jeannet et al. ..... 403/24

FOREIGN PATENT DOCUMENTS

FR 1181541 * 6/1959 ..... 15/144.1
GB 875618 * 8/1961 ..... 15/172
SE 151305 * 8/1955 ..... 15/144.1

OTHER PUBLICATIONS

Lion Corp., Matsumura Tatsuo, Brushing Pressure Control Toothbrush, Aug. 18, 1998, Pub. No.: 10215950, see abstract.

* cited by examiner

*Primary Examiner*—Mark Spisich
(74) *Attorney, Agent, or Firm*—Nora Stein-Fernandez

(57) ABSTRACT

A toothbrush having a hinge located between its head and its handle, provided by first and second hinge parts extending respectively from the head end of the toothbrush toward the handle end, and from the handle end toward the head end, in a longitudinally overlapping side by side relationship, the overlapping parts being able to rotate relative to each other through a restricted angle about an axis generally perpendicular to the longitudinal axis, the two parts being linked by a torsion element between them.

23 Claims, 7 Drawing Sheets

TOOTHBRUSH

This invention relates to toothbrushes, particularly toothbrushes for use by hand action and having a flexibility-modifying feature in their handle.

Toothbrushes having flexibility-modifying features in their handle are known, for example U.S. Pat. No. 5,054,154 discloses the possibility of a toothbrush having a hinge between its grip handle and its neck, i.e. that part of the toothbrush between the handle and the head. Generally however, the flexibility modifying features of known toothbrushes have been unable to focus the flexibility of the toothbrush at a precise point in the toothbrush structure, so that as a consequence the flexible bending of the toothbrush occurs over a vaguely defined zone. Also precise "tuning" of the flexibility of the toothbrush can be difficult with known constructions.

An object of this invention is to overcome the above-mentioned problems of known toothbrushes and to provide a toothbrush in which flexibility can be focused at a precisely defined location and can be easily tuned independently of selection of particular construction materials for the toothbrush.

According to this invention a toothbrush has a head and a grip handle, with a neck in between the head and grip handle, all disposed along a longitudinal toothbrush axis, bristles projecting from the head in a direction generally perpendicular to the toothbrush axis, having a hinge located between its head and its handle, the hinge being provided by a first hinge part extending from the head end of the toothbrush toward the handle end, and a second hinge part extending from the handle end toward the head end, the said first and second hinge parts being arranged in a longitudinally overlapping side by side relationship on opposite sides of a plane parallel to the longitudinal axis and to the bristle direction, the overlapping parts being able to rotate relative to each other through a restricted angle about an axis generally perpendicular to the longitudinal axis and to the bristle direction, the two parts being linked by a torsion element between them.

The hinge may be located at any part of the toothbrush between the head and the handle but is preferably located either between the handle and the neck or between the neck and the head. In this description the head is defined as that part of the toothbrush which bears the bristles, the handle is defined as that part of the toothbrush which is held by the hand during use, and the neck is defined as that part of the toothbrush between the head and handle. Often a toothbrush narrows over the neck region between the handle and head.

The direction of the said relative rotation is suitably from an initial unstressed rest position to a position where the toothbrush head is displaced from its rest position in the bristle tip—toothbrush head direction, and the torsion element is suitably an element which is capable of providing torsional force to return the head in the opposite direction toward, ideally into, the rest position. The said displacement is caused by pressure applied to the tips of the bristles by the action of the user brushing his/her teeth and consequently applying pressure thereto.

In one embodiment the toothbrush has a single first hinge part extending from the head end of the toothbrush toward the handle end, and a single second hinge part extending from the handle end toward the head end, the first and second hinge parts being respectively on either side of a plane parallel to and which includes the longitudinal axis.

In another embodiment the toothbrush has at least two respectively first or second hinge parts extending respectively either from the head end of the toothbrush toward the handle end, or from the handle end of the toothbrush toward the head end, and respectively either a second hinge part extending from the handle end toward the head end and between two of the said at least two first hinge parts, or a first hinge part extending from the head end toward the handle end between two of the said at least two second hinge parts.

The toothbrush of the invention may be provided as a separate head end and handle end. In one embodiment these may be connected only by the torsion element. Alternatively the toothbrush of the invention may have an integral head end and handle end, with at least part of the torsional element formed integrally between and linking them.

For example a separate head end and handle end may be constructed having respective connecting parts which co-operate together to retain the head end and handle end together. For example such connecting parts may co-operate by a snap fit co-operation, i.e. where one or both of the connecting parts are resilient and the action of bringing the connection parts together forces a ramp surface on one part over and beyond a ramp surface on the other part, so that to disconnect the connecting parts again requires resilience to be overcome. If the head end and handle end are made of resilient plastics materials the resilience of such plastics materials can be used to provide such a resilient snap-fit connection.

There may be an axle defining the axis of relative rotation. This axle may pass through a bearing hole, or fit into a bearing socket, respectively through or in at least the first or second hinge part. For example the bearing hole may be in the form of an axle hole passing completely through the respective first and/or second part. For example the bearing socket may be in the form of a concavity, not passing all the way through the respective first or second part, and in which sits the stub end of the axle. Such an axle may be separate to or integral with the first or second hinge part, and the said relative rotation through a restricted angle may be about this axis. Alternately the parts may be linked by a torsion element, which may be integral with the first and/or second hinge parts.

When the toothbrush is of the above described separate head end and handle end construction the head end and handle end may be made of different constructional materials or differently colored materials to for example visually emphasis its construction.

The torsion element is an element that applies torsion against and to restrict the relative rotation of the parts, so that the two parts can only rotate through a restricted angle relative to each other, and this rotation generates a resilient torsional effect tending to return the toothbrush toward the original rest configuration of the first and second parts. The torsion element thereby imparts flexibility into the handle of the toothbrush, helping to reduce the possibility of excessive toothbrushing pressure.

One type of torsion element comprises a torsion element made of resilient material, for example made of the plastics material of which the head end and handle end of the toothbrush are made, connected to the head end and handle end, e.g. integrally connected, and located between them. Such a torsion element may comprise a laterally extending, i.e. perpendicular to the direction of the toothbrush longitudinal axis, torsion bar. This torsion bar may be of any suitable cross section, e.g. of non-circular cross section about the axis of relative rotation of the head end and handle end, made of a resilient material, which may be integrally made of the plastics material of the toothbrush head end or handle end. Such a torsion bar may extend completely or partially across the toothbrush width between the said first and second hinge parts. Such a torsion bar may link, e.g. integrally link, the first and second hinge parts. When one of respectively the said head or handle ends is provided with such a torsion bar the other end may be provided with an axle socket into and preferably through which the torsion bar extends, the axle socket being of cross section similar to the torsion bar.

Suitably such a torsion bar and axle socket may also comprise the connecting parts referred to above, for example the torsion bar may snap-fit into the axle socket. Alternatively the torsion bar may integrally link the first and second parts as mentioned above.

Another type of torsion element comprises an elastomeric material, bonded to the head end and/or handle end, e.g. to one or both of the said first and second hinge parts, and located between them. Methods of binding elastomeric and plastic materials in toothbrushes are well known in the art of toothbrush manufacture. For example the plastic and elastomeric parts may be fused together, e.g. as disclosed in WO 98/27847. Such an elastomeric material may prevent unlimited free rotation of the parts relative to each other and may cause the parts to rotate relatively only through the said restricted angle. Such an elastomeric material may be in the form of an infilling between the head and handle end, e.g. between the first and second hinge parts. Such an infilling may be in the form of a layer, e.g. sandwiched laterally between the said overlapping parts. In this construction the natural elasticity of the elastomeric material may serve to generate the required torsional force when the first and second hinge parts rotate relative to each other through their restricted angle.

Additionally or alternately the elastomeric material may be in the form of a torsion bar extending between the head end and handle end, e.g. between the first and second hinge parts, and may be aligned with the axis about which the said relative rotation through a restricted angle takes place. Such a torsion bar twists as the said parts rotate relative to each other, and a torsion force is thereby generated. Such an elastomeric torsion bar may be bonded to the plastic material of the said first and second parts.

Such an infilling may comprise a composite structure of elastomer and the plastic material of the toothbrush. In such a structure the plastic material may be in the form of structures extending within the infilling from the surface of the head end and handle end, e.g. the first and second hinge parts, which resist the said relative rotation, so as to make the infilling less flexible than it would be without such structures. For example such a composite structure may comprise a mass of elastomeric material, and embedded within this mass there may be plastic material parts linked with, e.g. integrally made with, the first and/or second parts such that when the first and second parts move relative to each other e.g. through the restricted angle the plastic material parts attempt to move within the elastomer mass and thereby experience a torsional force resulting from the natural elasticity of the elastomer material mass.

Such a construction can allow flexing of the toothbrush preferentially in the plane that includes the longitudinal axis and the bristle direction, and can also provide damping of the flexibility. In this way flexibility in other directions such as widthwise can be limited. The elastomeric material in this construction can consequently function as a fully floating bearing.

Another type of torsion element comprises a thin link of a resilient material, preferably integral with the plastic material of the first and second hinge parts and made of the plastic material of the toothbrush, between the head end and handle end, e.g. between the first and second hinge parts such that the relative rotation of the said parts as described above about the axis applies a twisting force to the link, which thereby can, if it is of suitable dimensions, generate a torsion force against the said rotation.

For example such a link may comprise a spiral or helical structure of the plastic material linking the head end and handle end, e.g. between and linking the first and second hinge parts. Such a spiral or helical structure may be integrally made with the plastic material of the head and handle end, e.g. of the first and second hinge parts. The centre of the spiral structure or the axis of the helical structure may comprise the axis about which the said relative rotation takes place. There may be an axle at the centre of the spiral or helix, and the helical or spiral structure(s) may be linked to his axle. Such a spiral structure may comprise a plurality of arms radiating in a spiral curve from a centre of the spiral. Such a helical structure may comprise one or more coils of a helix surrounding a central helix axis. For example if there is a single first or second hinge part located laterally between respectively two second or first hinge parts there may be two such spiral or helical structures. For example the first and/or second hinge part may have an opening therein, with the centre of the spiral structure located at or near the centre of the opening, and the outer ends of the spiral arms may be linked to the inner surface of the opening.

When such a spiral or helical structure is present, the said relative rotation between the first and second hinge parts may wind the spiral or helix up, and thereby create a torsion force in the opposite twist direction. In one form of such a construction a spiral structure may comprise a central axle defining the axis of relative rotation of the first and second hinge parts, and linked, e.g. integrally made with the first or second hinge part, from which radiate one or preferably more spiral arms, the spiral arm(s) being linked, preferably integrally, respectively with the second or first hinge part. In one form of such a construction a helical structure may comprise a central axle defining the axis of relative rotation of the first and second hinge parts, and linked, e.g. integrally made with the first or second hinge part, from which radiate one or more helical arms, the helical arm(s) being linked, preferably integrally, respectively with the second or first hinge part.

The link may alternatively be made so thin that it effectively makes no practical contribution to the flexibility of the link, and can be provided primarily to allow the plastic parts of the toothbrush to be molded integrally of plastic material, e.g. the link may be formed by residual plastic material in an injection molding channel, with the torsion element comprising an elastomeric material between the first and second hinge parts. Such a thin link can be made so thin that it can flex completely freely or even snap or shear when the toothbrush is used, e.g. for the first time, so that the elastomeric material acts as the torsion element, because when such a link is used in a toothbrush of the invention, an elastomeric material as described above is also present between the parts.

Another type of torsion member is provided by a construction in which the head end and handle end are provided with respective torsion parts, at least one of which is resilient, and such that when the head end and handle end rotate relative to each other the respective torsion parts bear upon each other, e.g. as a result of the relative movement of one torsion part circumferentially relative to another, and the resilience generates a torsional force. Suitably the resilience of the said torsion parts is provided by at least one of them comprising a resilient elastomeric material.

For example one or more of the said torsion parts may comprise a first part extending radially from the axis of relative rotation of the head end and handle end, and the other part may comprise a second part located upon the arc followed by the first part during the relative rotation, such that the first and second parts bear upon each other during the relative rotation. One or both of such first and second parts may comprise a resilient elastomeric material.

For example alternatively two of respectively the first and second torsion parts may be located upon the arc followed by the first or second torsion part during the relative rotation, such that the first and second parts bear upon each other during the relative rotation. One or both of such first and second parts may comprise a resilient elastomeric material.

The toothbrush of the invention may also include co-operating end-stop means to encourage or cause the said parts to rotate relative to each other only through a restricted angle, e.g. structures which abut against each other at the limits of the restricted angle to thereby prevent further relative rotation. Such structures may for example project from facing surfaces of the overlapping parts, e.g. the surfaces of the first and second hinge parts, and may be respectively integral with such parts. When the link between the head end and handle end, e.g. between and linking the first and second hinge parts comprises the abovementioned spiral or helical structure of the plastic material, then such a structure may also function as an end-stop means by virtue of the spiral or helix becoming wound up and unable to rotate any further in a particular rotation direction.

By means of the above described construction of the toothbrush of the invention the flexibility of the toothbrush may be made independent of the plastic material of the toothbrush end, and for example can be determined by the composition, amount or shape of the elastomeric material. Moreover the flexibility of the handle can be determined by the position and construction of the hinge, so as to focus flexibility at a precise point in the toothbrush.

The invention will now be described by way of example only with reference to the accompanying drawings which show:

FIGS. 1 and 2 respectively plan and side views of one construction of the toothbrush of this invention.

FIGS. 3 and 4 respectively plan end side views of another construction of the toothbrush of the invention.

Figure 1:
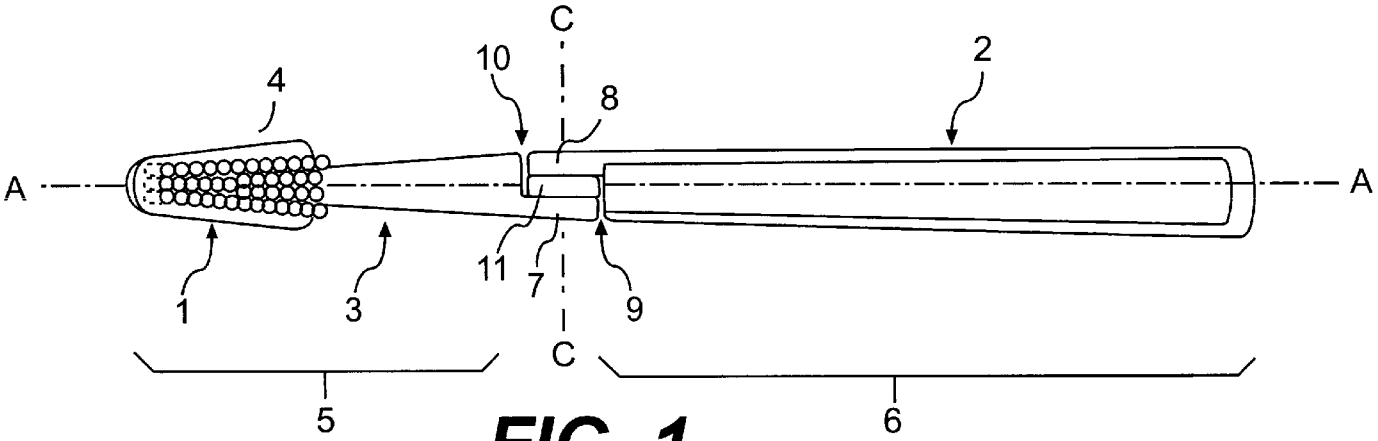
Figure 2:
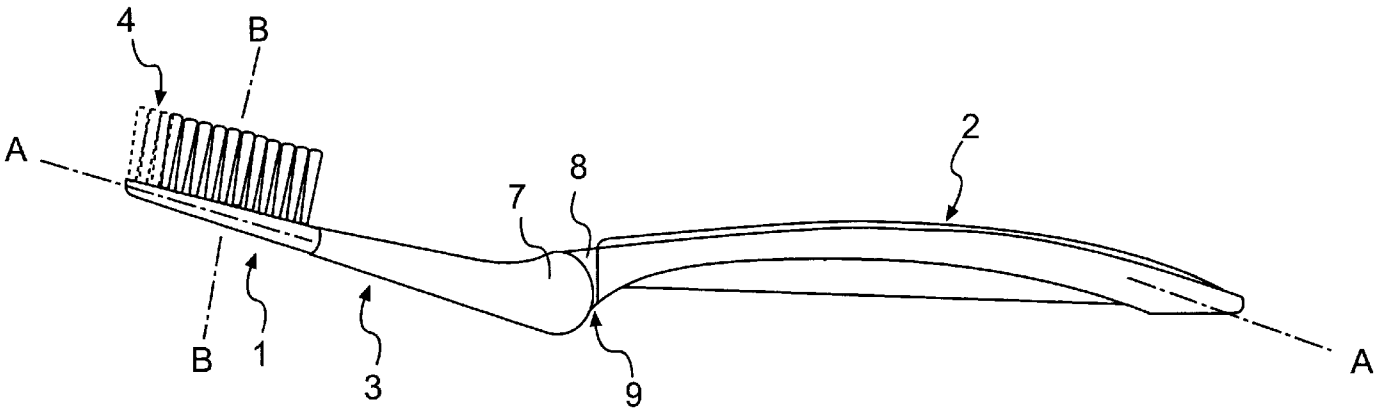

Referring to FIGS. 1 and 2 a toothbrush comprises a head 1, a grip handle 2, and a neck 3 between the head 1 and handle 2, all being disposed along a longitudinal toothbrush axis A—A. From the head 1 project bristles 4 in a general bristle direction B—B.

The toothbrush is made in the form of a separate head end 5, and a handle end 6. From the head end 5 a first hinge part 7 extends toward the handle end 6. From the handle end 6 a second hinge part 8 extends toward the head end 5. The two hinge parts 7 and 8 overlap longitudinally and are side by side on opposite sides of a plane parallel to the longitudinal axis A—A and to the bristle direction B—B, being the plane of the paper in FIG. 1. The hinge parts 7 and 8 are able to rotate relative to each other through a small angle about an axis C—C. It will be seen that the hinge parts 7 and 8 stop short of respectively the handle end and the head end leaving small gaps 9, 10 which provide clearance for the hinge parts 7 and 8 to rotate relative to each other. Located between the two hinge parts 7 and 8 is a torsion element 11 in the form of an elastomeric material bonded to each of the hinge parts 7, 8. The elastomeric material 11 is in the form of a layer, thin relative to the width of the toothbrush, and in the shape of a disc. Being in this form the toothbrush is able to flex about the axis C—C preferentially in the plane of the bristle direction B—B, i.e. in the plane of the paper of FIG. 2.

In a modification of the construction shown in FIGS. 1 and 2, either or both of the hinge parts 7, 8 may be pierced with a hole (not shown) through which extends an axle (not shown) aligned with the axis C—C, and about which relative rotation of the hinge parts 7, 8 can occur. Such an axle may be integral with a non-pierced hinge part 7 or 8.

Figure 3:
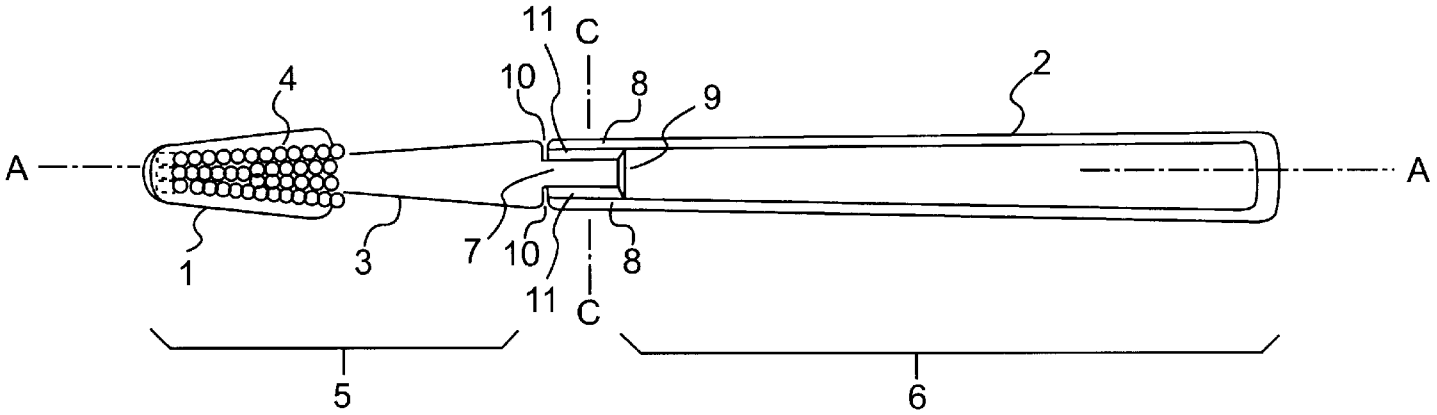
Figure 4:
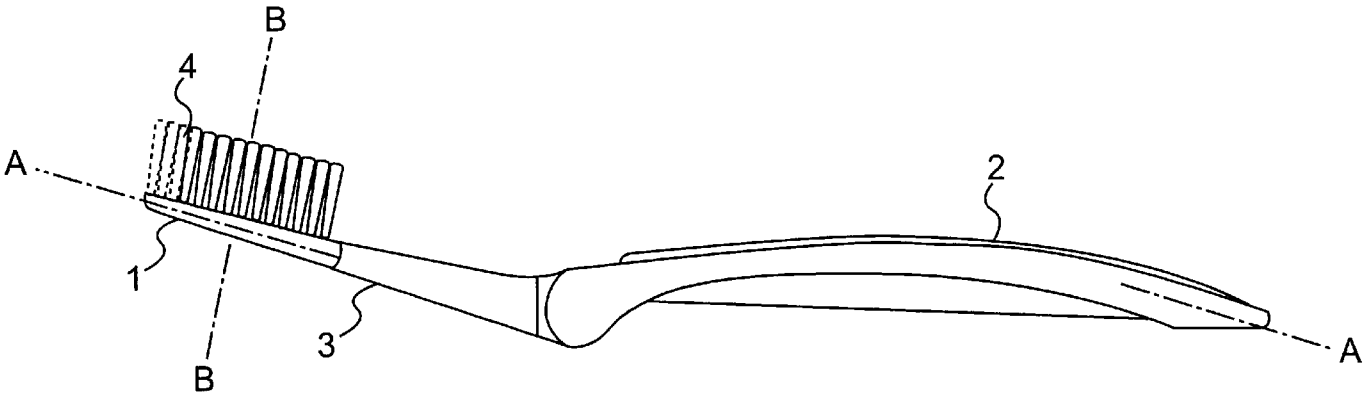

Referring to FIGS. 3 and 4, parts corresponding in function with those of FIGS. 1 and 2 are numbered correspondingly. From the handle end 6 of the toothbrush of FIGS. 3 and 4 extend two second parts 8. From the head end 5 of the toothbrush of FIGS. 3 and 4 extends one first hinge part 7, which extends between the two second hinge parts 8. It will be seen that the first and second hinge parts 7 and 8 stop short of respectively the handle end and the head end leaving small gaps 9, 10 which provide clearance for the hinge parts 7 and 8 to rotate relative to each other. Between the hinge parts 7 and 8 are two torsion elements 11 in the form of an elastomeric material bonded to the hinge parts 7, 8. In FIGS. 3 and 4 the arrangement of hinge parts 7 and 8 can be reversed such that the two first hinge parts 7 extend from the head end 5 and a single second part 8 extends from the handle end 6 between the two first hinge parts 7, again with two torsion elements 11 between them. The elastomeric material 11 is again in the form of a layer, thin relative to the width of the toothbrush, and in the shape of a disc. Being in this form the toothbrush is able to flex about the axis C—C preferentially in the plane of the bristle direction B—B, i.e. in the plane of the paper of FIG. 4.

In a modification of the construction shown in FIGS. 3 and 4, one or more of the first and/or second hinge parts 7, 8 may be pierced with a hole (not shown) through which extends an axle (not shown) aligned with the axis C—C, and about which relative rotation of the hinge parts 7, 8 can occur. Such axle or axles may be integral with a non pierced part hinge 7 or 8.

Figure 5:
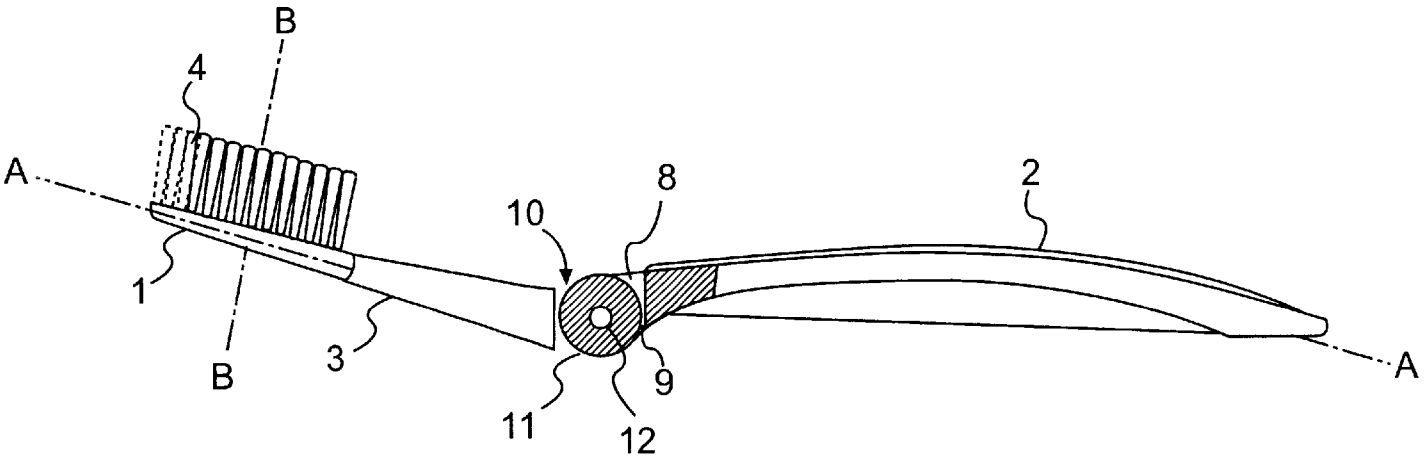
FIGS. 5 and 6 show alternative constructions of the hinge of toothbrushes of the invention in part sectioned side views.
Figure 6:
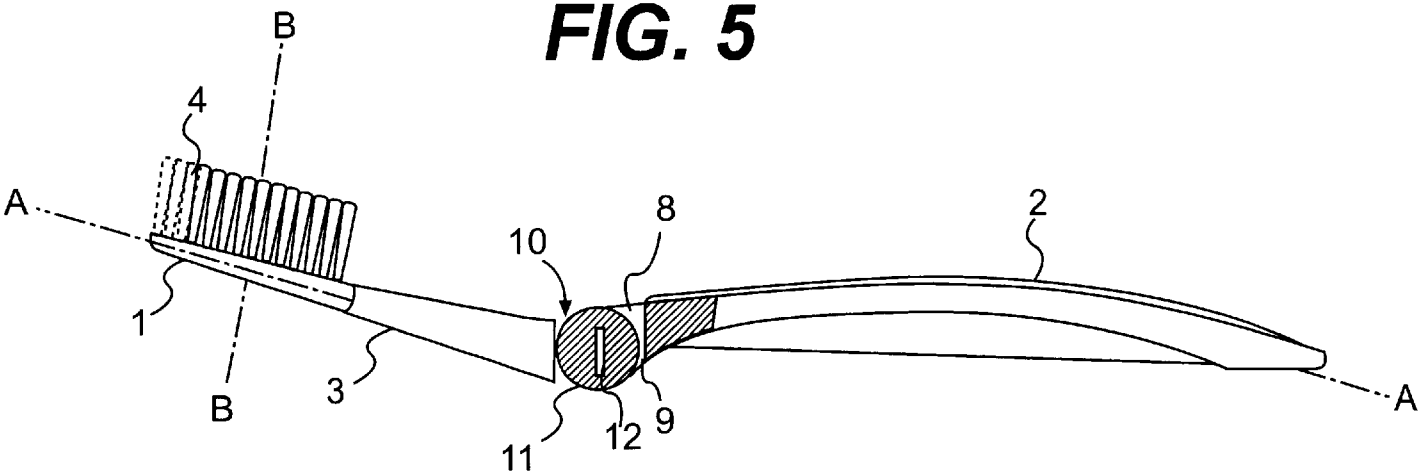
Figure 14:
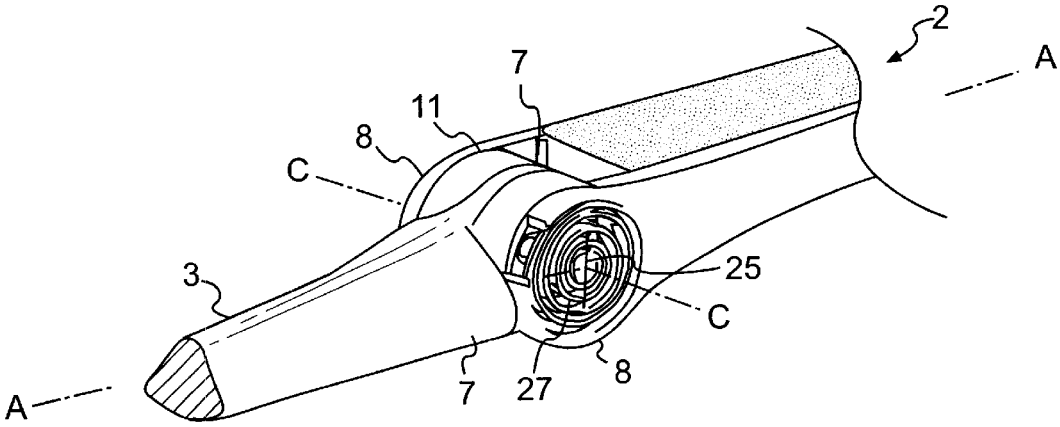

Referring to FIGS. 5 and 6, parts corresponding to the toothbrush of FIGS. 14 are numbered correspondingly. In FIGS. 5 and 6 the first and second hinge parts 7 and 8 are linked integrally by a thin plastic spine 12 which in FIG. 5 is circular in cross section and in FIG. 6 is rectangular in cross section. These linking spines 12 enable the toothbrush to be molded integrally. The spines 12 can be made so thin that they contribute little or nothing to the resilience or flexibility of the link between the hinge parts 7 and 8, and may also shear when the toothbrush is used. When the spines 12 shear during use, although the toothbrush is provided with the spines linking the hinge parts 7 and 8, on use the hinge parts 7 and 8 and the respective head and handle ends become separated. The spines 12 can alternatively also function as torsion elements, the rectangular sectioned spine 12 of FIG. 6 allowing fine control of the resilience of the toothbrush handle by adjustment of its dimensions. The spines 12 are enclosed within a further torsion element 11 in the form of an elastomeric material.

The elastomeric material 11 is again in the form of a layer, thin relative to the width of the toothbrush, and in the shape of a disc. Being in this form the toothbrush is able to flex about the axis C—C preferentially in the plane of the bristle direction B—B, i.e. in the plane of the paper of FIGS. 5 and 6.

Referring to FIGS. 7 to 15, parts corresponding to the toothbrush of FIGS. 1 to 6 are numbered correspondingly.

Figure 7:
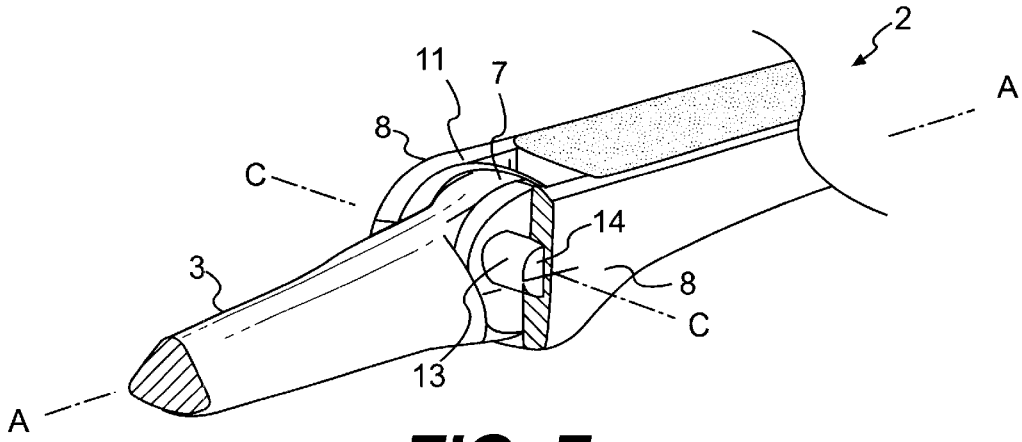
FIGS. 7 to 18 show perspective part cutaway views of alternative constructions of toothbrush of this invention.

FIG. 7 shows a toothbrush of similar construction to that of FIGS. 3 and 4, i.e. with a single first hinge part 7 extending between two second hinge parts 8. Projecting laterally from the first hinge part 7 are two opposed stub axles 13 which fit into corresponding socket bearings 14 in the two second hinge parts 8, allowing the first and second hinge parts 7 & 8 to rotate relative to each other about the axis C—C. The handle end 2 and head end 3 of the toothbrush may be manufactured separately and fitted together, e.g. the first hinge part 7 snap-fitting between the two second hinge parts 8. There is an elastomeric material infilling 11 between the first and second hinge parts 7, 8 acting as a torsion element and which limits their relative rotation.

Figure 8:
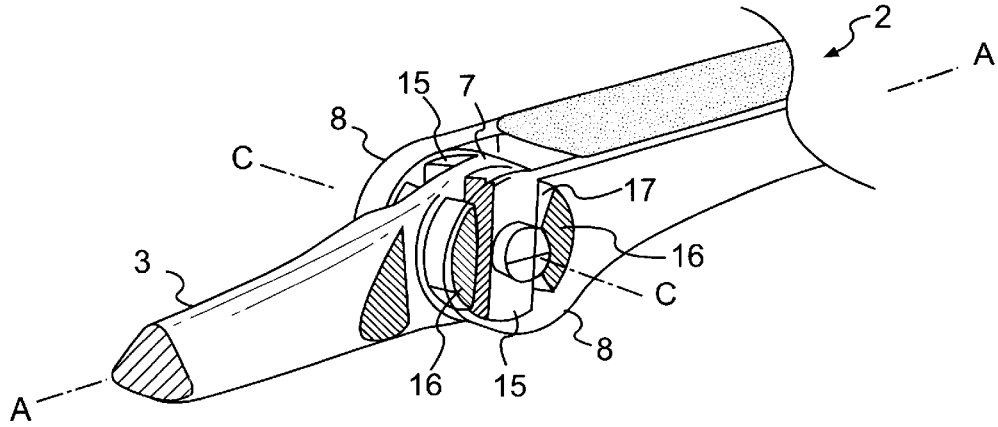

FIG. 8 shows a toothbrush of similar construction to that of FIG. 7, and corresponding parts are numbered correspondingly. Between the first hinge part 7 and second hinge part 8 are end stop means 15, 16, being structures integral with and projecting from the surface of the respective part 7, 8 having abutment surfaces 17 which abut to define the limits of relative rotation. There is an elastomeric material infilling 11 (not shown for clarity) between the first and second hinge parts 7, 8 acting as a torsion element and which limits their relative rotation.

Figure 9:
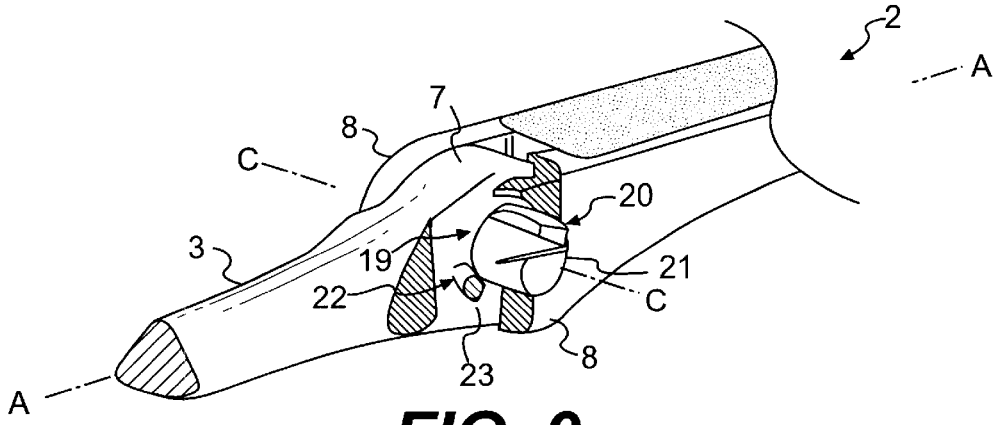

FIG. 9 shows a toothbrush with a single first hinge part 7 extending between two second hinge parts 8. The first and second hinge parts 7, 8 are pierced with coaxial holes 19, 20, through which passes an axle 21 made of elastomeric material bonded to the plastic material of the first and second hinge parts 7, 8. On relative rotation of the first and second hinge parts 7, 8 the axle 21 acts as a torsion bar. Between the first and second hinge parts 7, 8 are end stop means in the form of slots 22 in the first hinge part 7 and integral projections 23 into slots 22 from the surface of the second hinge means 8. The projections 23 have only limited movement in the slots 22, thereby allowing only limited relative rotation.

Figure 10:
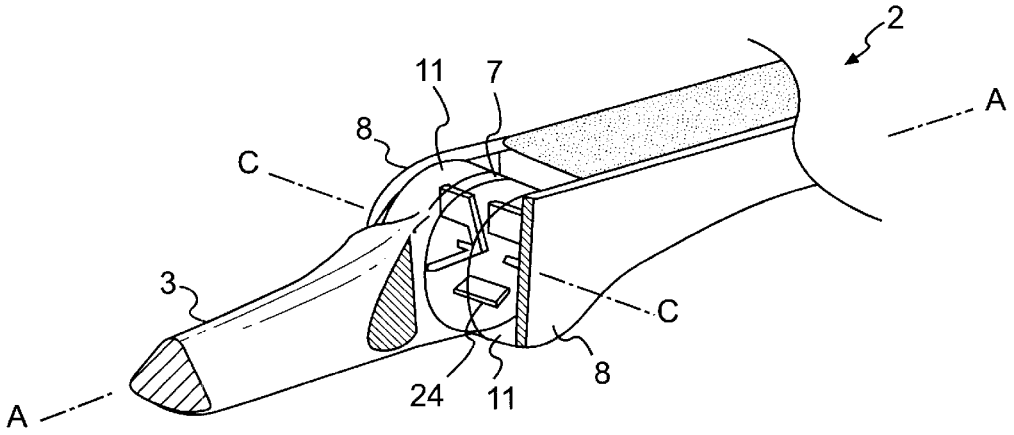
Figure 11:
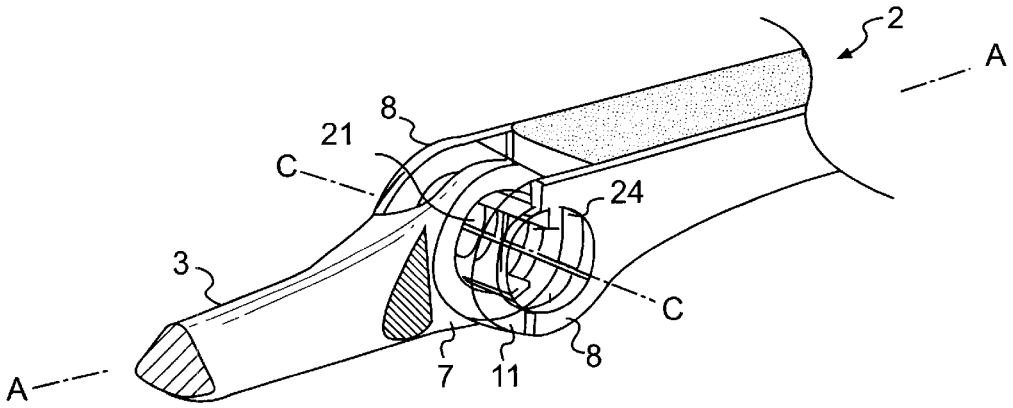
Figure 12:
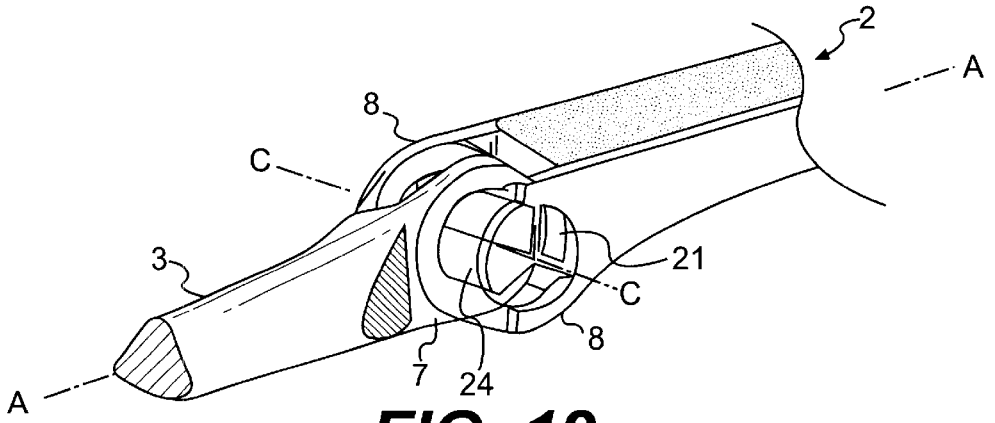

FIGS. 10, 11 and 12 all show toothbrushes in which there is a single first hinge part 7 extending between two second hinge parts 8, with an elastomer material infilling 11 between and bonded to the first and second hinge parts 7, 8. In FIG. 10 the infilling 11 is in the form of a layer sandwiched between the parts 7, 8 and in FIGS. 11 and 12 an elastomeric material axle 21 is present, similar to that 21 of FIG. 9. In each of the three constructions shown in FIGS. 10, 11 and 12, there are plastic material structures 24 extending within the infilling 11 integrally from in FIG. 10 the surface of the first hinge part 7, and in FIGS. 11 and 12 from the surface of the second hinge part 8. These structures 24 are in the form of vanes, baffles or paddles which resist the said relative rotation, so as to make the infilling 11 less flexible than it would be without the structures 24.

Figure 13:
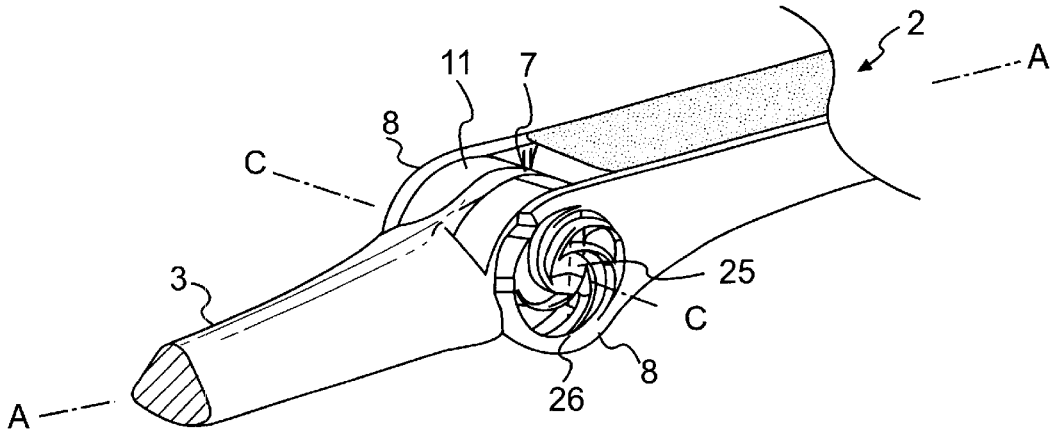
Figure 15:
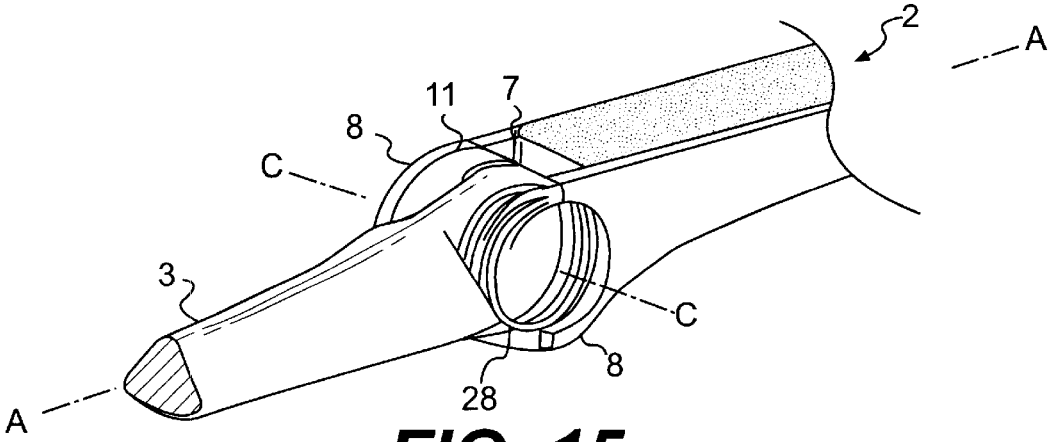

FIGS. 13, 14 and 15 show toothbrushes of the invention in which there are integral links between the first and second hinge parts 7, 8 which comprise a spiral or helical structure of the plastic material, parts of the toothbrush corresponding to parts of the toothbrushes of FIGS. 1 to 12 above being correspondingly numbered. There is also an elastomer infilling 11 between the parts 7, 8. In FIGS. 13, 14 and 15 a single first hinge part 7 extends between two second hinge parts 8. In FIGS. 13 and 14 an axle 25 extends from the lateral surfaces of the first hinge part 7 and defines the axis of relative rotation C—C. In FIG. 13, axle 25 is integrally linked to the second hinge part 8 by number of spirally curved arms 26. In FIGS. 13 and 14, the second hinge part 8 has an opening therein, i.e. being formed into a ring shape, with the centre 25 of the spiral structure located at or near the centre of the opening, and the outer ends of the spiral arms 26 are linked to the inner surface of the opening. In FIG. 14, axle 25 is integrally linked to the second hinge part 8 by single spirally curved arm 27. In FIG. 15 each lateral surface of the first hinge part 7 is linked to the second hinge parts 8 by an integral helical coil 28 of the plastics material. When such spiral or helical structures 26, 27, 28 are present, the said relative rotation between the first and second hinge parts 7, 8 winds the spiral or helix up, and thereby creates a torsion force in the opposite rotation direction.

Figure 16:
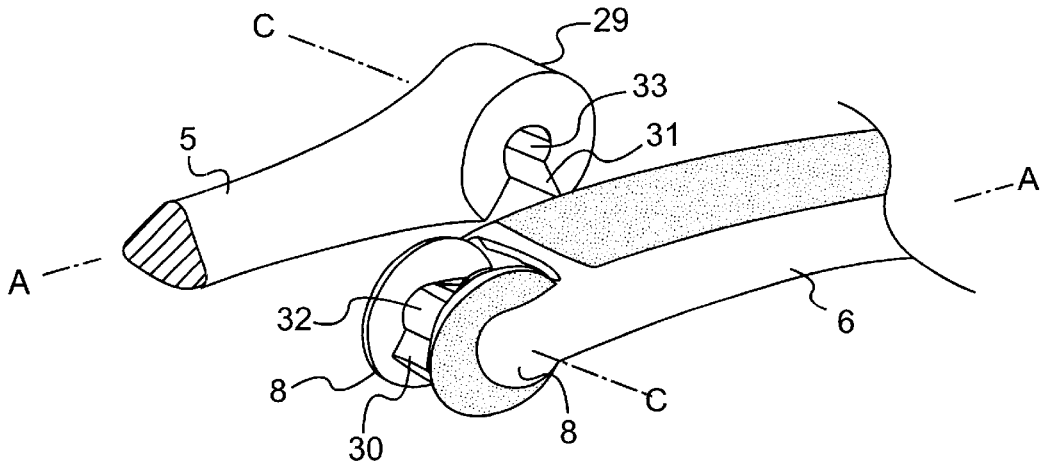

Referring to FIG. 16, parts corresponding to the toothbrush of FIGS. 1–15 are numbered correspondingly. The toothbrush has a separate head end 5 and a handle end 6 constructed having respective connecting parts 29, 30 which co-operate together to retain the head end 5 and handle end 6 together. The connection parts 29, 30 co-operate by a snap fit co-operation, i.e. both of the connecting parts 29, 30 are made of resilient plastic material and the action of bringing the connection parts 29, 30 together forces a ramp surface 31 on one part 29 over and beyond a ramp surface 32 on the other part 30, so that to disconnect the connecting parts 29, 30 again requires resilience to be overcome.

The torsion element in the toothbrush of FIG. 16 comprises a laterally extending torsion bar 32 of non-circular cross section about the axis of relative rotation C—C of the head end 5 and handle end 6, made integrally of the plastics material of the toothbrush head end 5 and handle end 6. The torsion bar 32 extends across the toothbrush width between two second hinge parts 8, the connecting part 29 comprising a first hinge part having an axle socket 33 through which the torsion bar 32 extends when the parts 29, 30 are connected together. The axle socket 33 is of cross section similar to the torsion bar 32.

Figure 17:
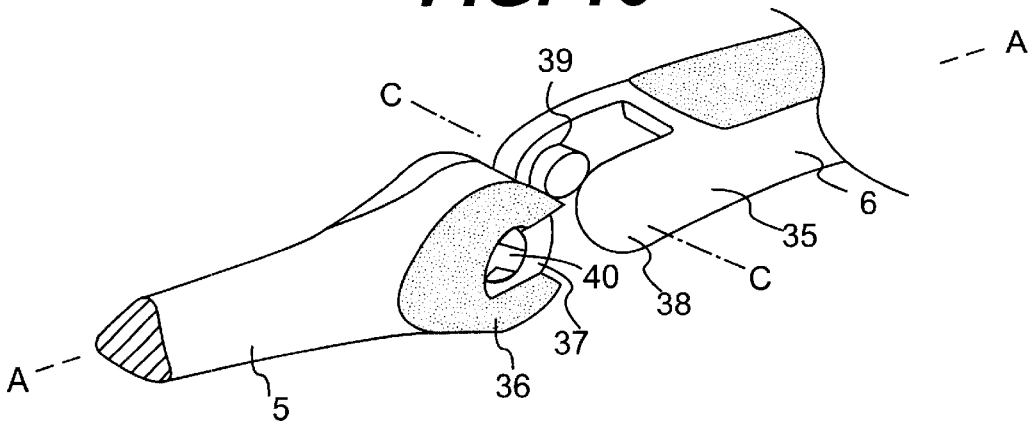

Referring to FIG. 17 a toothbrush is shown, in which parts corresponding to the toothbrush of FIGS. 1–15 are numbered correspondingly. The toothbrush has a separate head end 5 and a handle end 6 having a torsion member provided by a construction in which the head end 5 and handle end 6 are provided with respective torsion parts, and one of the said torsion parts 34 comprises radial first part 35 extending radially toward the handle 6 of the toothbrush from the axis of relative rotation C—C of the head end 5 and handle end 6, and the other part 36 comprises a second part located upon the arc followed by the radial first part during the relative rotation, such that the first 35 and second part 36 bear upon each other during the relative rotation. The second parts 36 are made of a resilient elastomeric material. The resilient force so generated applies a torsional effect upon the first part 35.

The toothbrush of FIG. 17 has a first hinge part 37, which when the head end 5 and the handle end 6 are connected together fits between two second hinge parts 38 on the handle end. The head end 5 and handle end 6 function as connecting parts as the ramp surface 39 can snap into the socket 40. The ramp surface 39 also acts as an axle in the socket 40 about which the head end 5 and handle end 6 can rotate relative to each other.

Figure 18:
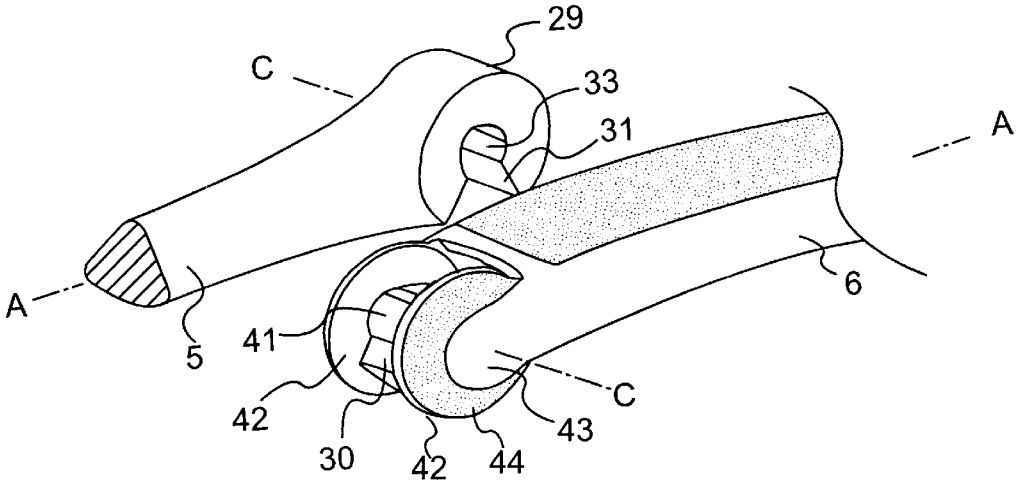

Referring to FIG. 18, parts corresponding to the toothbrush of FIGS. 16 are numbered correspondingly. The toothbrush has a separate head end 5 and a handle end 6 constructed having respective connecting parts 29, 30 which co-operate together to retain the head end 5 and handle end 6 together. The connection parts 29, 30 co-operate by a snap fit co-operation, i.e. both of the connecting parts 29, 30 are made of resilient plastic material and the action of bringing the connection parts 29, 30 together forces a ramp surface 31 on one part 29 over and beyond a ramp surface 32 on the other part 30, so that to disconnect the connecting parts 29, 30 again requires resilience to be overcome.

The torsion element in the toothbrush of FIG. 18 comprises a laterally extending axle 41 of non-circular cross section about the axis of relative rotation C—C of the head end 5 and handle end 6, made integrally of the plastics material of the toothbrush head end 5 and handle end 6. The axle 41 extends across the toothbrush width between two disc-shaped end flanges 42. The combination of connecting part 29, axle 41 and end flanges 42 comprises a first hinge part. The end flanges 42 are connected to second hinge parts 43 only by means of a disc of elastomer 44 bonded to both the end flanges 42 and the second hinge parts 43. The elastomer 44 comprises a torsion element, so that first and second hinge parts 42, 43 can rotate about a restricted angle relative to each other. Any of the other types of torsion element discussed above with reference to the preceding figures may also be provided between the end flanges 42 and the second hinge part 43.

In use, the toothbrushes of FIGS. 1–18 operate in a similar manner. Pressure from tooth brushing applied to the head 1 of the toothbrush whilst the handle 2 is held causes the head end 5 and handle end 6 to articulate resiliently about the hinge, such that the first hinge part 7 and second hinge part 8 rotate relative to each other against a torsional force applied by the torsion element, and thereby relieve excess brushing pressure. The direction of the relative rotation, caused by pressure applied to the tip of the bristles by the action of the user brushing his/her teeth, is from an initial unstressed rest position, to a position where the toothbrush head is displaced from its rest position in the bristle tip—toothbrush head direction, that is along the line B—B downwards in the drawings of FIGS. 1 to 17. The torsion elements 11, 21, 26, 27, 28, 29, 30, 35, 36, 44 are capable of providing torsional force to return the head in the opposite direction toward the rest position. The degree of resilient articulation can be controlled by the dimensions of, and materials of which the toothbrushes are made, particularly the first and second hinge parts 7, 8 and the torsion elements 11, 21, 26, 27, 28, 44.

What is claimed is:

1. A toothbrush with a head and a grip handle, with a neck in between the head and grip handle, all disposed along a longitudinal toothbrush axis, bristles projecting from the head in a direction generally perpendicular to the toothbrush axis, having a hinge located between its handle and its neck, wherein the hinge is provided by a first hinge part extending from the neck of the toothbrush toward the handle, and a second hinge part extending from the handle toward the head, the first and second hinge parts being arranged in a longitudinally overlapping side by side relationship on opposite sides of a plane parallel to the longitudinal axis and to the bristle direction, the overlapping hinge parts beingable to rotate relative to each other through a restricted angle about an axis generally perpendicular to the longitudinal axis, the two hinge parts being linked by a torsion element between them, and wherein the torsion element comprises an elastomeric material, bonded to one or both of the said hinge parts, and located between them.

2. A toothbrush according claim 1, wherein the toothbrush has a single first hinge part extending from the neck of the toothbrush toward the handle, and a single second part extending from the handle toward the head, the two hinge parts being respectively on either side of a plane which includes the longitudinal axis.

3. A toothbrush according to claim 2, wherein the elastomeric material is in the form of a layer sandwiched laterally between the overlapping hinge parts.

4. A toothbrush according to claim 2, wherein the elastomeric material is in the form of an axle or torsion bar between the first and second hinge parts.

5. A toothbrush according to claim 1, wherein the toothbrush has at least two first hinge parts extending from the neck of the toothbrush toward the handle and a second hinge part extending from the handle toward the head, the second hinge part extending between two of the respective first hinge parts.

6. A toothbrush according to claim 5, wherein the elastomeric material is in the form of a layer sandwiched laterally between the overlapping hinge parts.

7. A toothbrush according to claim 5, wherein the elastomeric material is in the form of an axle or torsion bar between the first and second hinge parts.

8. A toothbrush according to claim 1, wherein the first hinge part has an axle integral therewith and which defines the axis about which the hinge parts are able to rotate, and the second hinge part has a bearing hole through which the axle rotatably fits or a bearing socket in which the axle rotatably sits.

9. A toothbrush according to claim 8, wherein the elastomeric material is in the form of a layer sandwiched laterally between the overlapping hinge parts.

10. A toothbrush according to claim 1, wherein the elastomeric material is in the form of a layer sandwiched laterally between the overlapping hinge parts.

11. A toothbrush according to claim 1, wherein the elastomeric material is in the form of an axle or torsion bar between the first and second hinge parts.

12. A toothbrush according to claim 1, wherein the torsion element comprises a thin integral link between the parts such that the relative rotation of the parts about the rotation axis applies a twisting force to the link.

13. A toothbrush according to claim 12, wherein the torsion element comprises a spiral or helical structure linking the head and handle, and the relative rotation between the first and second hinge parts winds the spiral or helix up, and thereby creates a torsion force in the opposite twist direction.

14. A toothbrush according to claim 12, wherein the integral link is made so thin that it can flex completely freely or snap or shear when the toothbrush is used.

15. A toothbrush according to claim 1, wherein the neck and handle are provided with respective torsion parts, at least one of which is resilient, and such that when the neck and handle rotate relative to each other about the rotation axis the respective torsion parts bear upon each other as a result of the relative movement of one torsion part circumferentialy relative to another, and the resilience generates a torsional force.

16. A toothbrush according to claim 15, wherein one or more of the said torsion parts comprises a first part extending radially from the rotation axis, and the other part comprises a second part located upon the arc followed by the first part during the relative rotation, such that the first and second parts bear upon each other during the relative rotation.

17. A toothbrush according to claim 15, wherein two of respectively the first and second torsion parts are located upon the arc followed by the first or second torsion part during the relative rotation, such that the first and second parts bear upon each other during the relative rotation.

18. A toothbrush according to claim 1 characterised by co-operating end-stop means to encourage or cause the overlapping hinge parts to rotate relative to each other through a restricted angle.

19. A toothbrush according to claim 18, wherein the end stop means comprise structures which abut against each other at the limits of the restricted angle to prevent further relative rotation.

20. A toothbrush according to claim 1 wherein the toothbrush has at least two second hinge parts extending from the handle of the toothbrush toward the head, and a first hinge part extending from the neck, the said first hinge part extending between two of the second hinge parts.

21. A toothbrush according to claim 20 wherein the torsion element comprises a laterally extending torsion bar between the first and second hinge parts and integrally linking the first and second hinge parts.

22. A toothbrush according to claim 1, wherein the second hinge part has an axle integral therewith and which defines the axis about which the hinge parts are able to rotate, and the first hinge part has a bearing hole through which the axle rotatably fits or a bearing socket in which the axle rotatably sits.

23. A toothbrush according to claim 1 wherein the torsion element comprises a laterally extending torsion bar between the first and second hinge parts and integrally linking the first and second hinge parts.

* * * * *